US006565204B2

(12) United States Patent
Matsuhashi et al.

(10) Patent No.: US 6,565,204 B2
(45) Date of Patent: May 20, 2003

(54) IMAGE-FORMING METHOD AND TRANSFER SHEET FILM THEREFOR AS WELL AS IMAGE-FORMING APPARATUS

(75) Inventors: Kunihiko Matsuhashi, Matsumoto (JP); Ayao Ogawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/083,634

(22) Filed: Feb. 25, 2002

(65) Prior Publication Data

US 2002/0135652 A1 Sep. 26, 2002

(30) Foreign Application Priority Data

Mar. 6, 2001 (JP) ..... 2001-062124

(51) Int. Cl.[7] ..... B41J 2/01

(52) U.S. Cl. ..... 347/103

(58) Field of Search ..... 347/103, 120, 347/20, 123, 111, 159, 141, 155, 127, 128, 17, 154, 61; 399/271, 290, 292, 293, 294, 33, 67, 320

(56) References Cited

U.S. PATENT DOCUMENTS 6,335,307 B1 * 1/2002 Imai et al.

* cited by examiner

*Primary Examiner*—Raquel Yvette Gordon
(74) *Attorney, Agent, or Firm*—Hogan & Hartson, LLP

(57) ABSTRACT

There are provided an image-forming method which is capable of improving image quality of a transfer image, and a transfer sheet film therefor, as well as an image-forming apparatus. An image is printed on at least one transfer sheet film provided for use on at least one of front and back surfaces of a print medium, by using sublimable dye ink, thereby causing the sublimable dye ink to be held in the transfer sheet film. The at least one transfer sheet film and the print medium are overlaid to each other such that a printing surface of the transfer sheet film faces the at least one surface of the print medium. The image is transferred by heating the transfer sheet film and the print medium overlaid to each other while applying pressure thereto and thereby causing diffusion of the sublimable dye ink held in the transfer sheet film in the at least one surface of the print medium for color development. Then, the transfer sheet film is removed from the print medium having the image formed thereon. The transfer sheet film is formed of a water-soluble and soft resin material, and the printing surface is formed to be a smooth surface.

20 Claims, 4 Drawing Sheets

IMAGE-FORMING METHOD AND TRANSFER SHEET FILM THEREFOR AS WELL AS IMAGE-FORMING APPARATUS

BACKGROUND OF THE INVENTION

1. Field of the Invention

This invention relates to an image-forming method using a print medium and a transfer sheet film, for thermally transferring an image printed by using a sublimable dye ink from the transfer sheet film onto the print medium, to thereby form the image on the print medium, and the transfer sheet film used therefor, as well as to an image-forming apparatus.

2. Prior Art

Conventionally, an image-forming method is known which transfers an image printed on a transfer paper by using a sublimable dye ink by one of various printing methods from the transfer paper to a print medium. This image-forming method overlays a printing surface of the transfer paper to a transfer surface of the print medium, heating the transfer paper and the print medium while applying pressure thereto e.g. by using a thermal press, thereby causing the sublimable dye ink held in the transfer paper to permeate from the printing surface of the transfer paper in a direction of thickness thereof into the transfer surface of the print medium through evaporation/diffusion to effect image transfer. Then, after completion of the image transfer, the transfer paper is peeled off the print medium.

In general, to transfer a high-quality image printed on a transfer paper onto a print medium while maintaining the high quality of the image, it is essential to press the transfer paper and the print medium against each other for intimate contact there between during the image transfer operation. However, the transfer paper has too coarse a printing surface to achieve complete and intimate contact with the print medium, so that minute gaps are produced between the transfer paper and the print medium, resulting in a transferred image with color irregularity. On the other hand, if a transfer sheet having a smooth and solid surface is used to overcome the problem, since the transfer sheet has no elasticity differently from the transfer paper described above, it is difficult to cause air to be expelled from between the surfaces of the transfer sheet and a print medium held in intimate contact with each other. Therefore, in this case as well, it is expected to produce a transferred image with color irregularity.

SUMMARY OF THE INVENTION

It is an object of the invention to provide an image-forming method which is capable of improving image quality of a transfer image, and a transfer sheet film therefor, as well as an image-forming apparatus.

To attain the above object, according to a first aspect of the invention, there is provided an image-forming method comprising the steps of:

printing an image on a printing surface of at least one sheet of a transfer sheet film prepared in a manner associated with at least one surface of a print medium, by using a sublimable dye ink, thereby causing the sublimable dye ink to be held in the at least one sheet of the transfer sheet film;

overlaying the at least one sheet of the transfer sheet film to the print medium such that the printing surface of the at least one sheet of the transfer sheet film faces the at least one surface of the print medium;

transferring the image by heating the at least one sheet of the transfer sheet film and the print medium overlaid to each other while applying pressure thereto, thereby causing diffusion of the sublimable dye ink held in the at least one sheet of the transfer sheet film into the at least one surface of the print medium for color development; and removing the at least one sheet of the transfer sheet film from the print medium having the image formed thereon, wherein the transfer sheet film is formed of a water-soluble and soft resin material, and the printing surface is formed to be a smooth surface.

According to the image-forming method, when an image is printed on the transfer sheet film, the sublimable dye ink is impregnated into the transfer sheet film and held in the same. Then, the transfer sheet film and the print medium are overlaid to each other such that the printing surface of the transfer sheet film faces the surface of the print medium, and then heated in this state, whereby the sublimable dye ink is transferred from the transfer sheet film deep into the surface layer of the print medium as migration particles having sizes at a molecular level and develops color to form an image thereon. Then, simply by removing the transfer sheet film from the print medium thereafter, the print medium having the image easily formed on the surface thereof is prepared.

In the present image-forming method, since the transfer sheet film formed of a water-soluble resin material is employed as a transfer medium, it is possible to maintain excellent ink absorbency during the printing process, which enables the sublimable dye ink to be stably impregnated into the transfer sheet film and held therein without being diffused. Therefore, when the transfer sheet film is heated in a state overlaid to the print medium with its printing surface facing the same, the sublimable dye ink is transferred directly onto the surface of the print medium without passing through the transfer sheet film or being hindered by air or the like trapped between the transfer sheet film and the print medium, so that the print image can be transferred faithfully. Further, since the printing surface of the transfer sheet film has smoothness, and the transfer sheet film is formed of a soft resin, when the transfer sheet film is pressed against the print medium, air trapped between the transfer sheet film and the print medium can be expelled easily, which ensures as intimate contact as possible between the transfer sheet film and the print medium. This makes it possible to form a clear and sharp transfer image without color irregularity on the print medium. It should be noted that the transfer sheet film is preferably formed of a material composed of a main component of PVA (polyvinyl alcohol) and an additive which exhibits slight tackiness when heated.

Preferably, the printing step includes printing images on respective printing surfaces of two sheets of the transfer sheet film prepared in a manner associated with front and back surfaces of the print medium, by using the sublimable dye ink, thereby causing the sublimable dye ink to be held in the two sheets of the transfer sheet film, the overlaying step including overlaying the two sheets of the transfer sheet film to the print medium such that the printing surfaces of the two sheets of the transfer sheet film face the front and back surfaces of the print medium, respectively, the transferring step including transferring the images by heating the two sheets of the transfer sheet film and the print medium overlaid to each other while applying pressure thereto, thereby causing diffusion of the sublimable dye ink held in the two sheets of the transfer sheet film into the front and back surfaces of the print medium for color development, and the removing step including removing the two sheets of the transfer sheet film from the print medium having the images formed thereon.

According to this preferred embodiment, an image is printed on each sheet of the transfer sheet film, whereby the sublimable dye ink is impregnated into the sheet of the transfer sheet film and held in the same. Then, the two sheets of the transfer sheet film and the print medium are overlaid to each other such that the respective printing surfaces of the two sheets of the transfer sheet film face the front and back surfaces of the print medium, and then heated in this state, whereby the sublimable dye ink is transferred from the sheets of the transfer sheet film deep into each surface layer of the print medium as migration particles having sizes at a molecular level and develop color to form an image thereon. Then, simply by removing the transfer sheet film from the print medium, the print medium having the images easily formed on the front and back surface thereof is prepared.

Therefore, this preferred embodiment provides the same advantageous effects as described above, and is capable of forming clear and sharp transferred images without color irregularity on both sides of the print medium.

More preferably, the transferring step includes simultaneously pressing and heating front and back surface sides of the print medium overlaid with the respective two sheets of the transfer sheet film.

According to this preferred embodiment, it is possible to increase heat efficiency. Further, since the front and back surfaces of the print medium can be treated under identical hating conditions, it is possible to fix ink uniformly on both the front and back surfaces as well as to prevent warpage of the print medium due to heating.

Preferably, the transferring step includes the step of pressing and the step of heating, these two steps overlapping each other in timing such thin the step of pressing starts before the step of heating starts, and the step of heating ends before the step of pressing ends.

According to this preferred embodiment, in the step of transferring the image, it is possible to heat the transfer sheet film and the print medium after removing air or bubbles trapped at the interface between (or between the contact surfaces of) the transfer sheet film and the print medium by pressing the transfer sheet film and the print medium against each other. In short, it is possible to carry out heat treatment after having placed the transfer sheet film and the print medium in complete and intimate contact, which ensures excellent transfer of the image. Further, since the step of pressing ends after heating is completed, it is possible to suppress warpage of the print medium due to heating.

Preferably, the image-forming method further includes the step of removing air from an interface between the print medium and the transfer sheet film overlaid to each other, between the overlaying step and the transferring step.

According to this preferred embodiment, before starting the step of transferring the image, it is possible to sufficiently remove a small amount of air or microscopic bubbles remaining in the interface between the print medium and the transfer sheet film, which ensures further reliable intimate contact between the two and excellent transfer of the image by the following heat treatment.

More preferably, the step of removing air includes overlaying a soft cushion sheet to the print medium and the transfer sheet film overlaid to each other, and pressing the transfer sheet film against the print medium via the cushion sheet.

According to this preferred embodiment, when pressed, the cushion sheet acts to extrude bubbles and the like, and hence it is possible to effectively remove bubbles trapped between the print medium and the transfer sheet film, thereby ensuring reliable intimate contact between the two. It should be noted that the cushion sheet is preferably formed of a material such as silicone, urethane, vinyl chloride, or the like.

Preferably, the image-forming method further includes the step of forcibly cooling the print medium between the transferring step and the step of removing air.

According to this preferred embodiment, after the image transfer is completed, the print medium is rapidly cooled. This makes it possible to properly prevent warpage of the print medium which might be caused owing to heating, and at the same time, there occurs no problem in handling the print medium after the image transfer since the print medium can be cooled sufficiently.

Preferably, the image-forming method further includes the step of forcibly cooling the print medium between ending of the step of heating and ending of the step of pressing in the transferring step.

According to this preferred embodiment, it is possible to rapidly cool the heated print medium after the image transfer, thereby reliably preventing warpage of the print medium due to heating.

Preferably, the step of removing the at least one sheet of the transfer sheet film includes dissolving the transfer sheet film in water.

According to this preferred embodiment, since the transfer sheet film can be dissolved by immersion in water, it is possible to remove the transfer sheet film from the print medium very easily. Further, since the original image faintly left on the transfer sheet film can be caused to completely disappear, it is possible to prevent forgery of the print medium.

Preferably, the printing step includes printing the image by an ink jet printing method.

According to this preferred embodiment, it is possible to print a clear image. Particularly in color printing, the ink jet printing method is more advantageous than the thermal sublimation printing method using ink films of the three primary colors, in that it is possible to reduce ink usage and increase printing speed as well as to obtain an image with high resolution.

Preferably, the transfer sheet film is formed of a material which exhibits slight curability when heated.

According to this preferred embodiment, it is easy to remove the transfer sheet film after the heat treatment. Further, even when pressed and heated, the transfer sheet film do not adhere to the press means, and hence it is possible to prevent degradation of quality of the transfer image.

Preferably, the print medium is a card.

According to this preferred embodiment, it is possible to form a high-quality image on the card. For example, a photographic image for use on a license or certificate can also be formed without color irregularity or blur.

To attain the above object, according to a second aspect of the invention, there is provided a transfer sheet film for use in an image-forming method comprising the steps of:

printing an image on a printing surface of at least one sheet of the transfer sheet film prepared in a manner associated with at least one surface of a print medium, by using a sublimable dye ink, thereby causing the sublimable dye ink to be held in the at least one sheet of the transfer sheet film, overlaying the at least one sheet of the transfer sheet film to the print medium such that the printing surface of the at least one sheet of the transfer sheet film faces the at least one surface of the print medium, transferring the image by heating the at least one sheet of the transfer sheet film and the print medium overlaid to each other while applying pressure thereto, thereby causing diffusion of the sublimable dye ink held in the at least one sheet of the transfer sheet film into the at least one surface of the print medium for color development, and removing the at least one sheet of the transfer sheet film from the print medium having the image formed thereon, wherein the transfer sheet film is formed of a water-soluble and soft resin material, and the printing surface is formed to be a smooth surface.

According to the second aspect of the invention, temporary impregnation of the transfer sheet film with ink can be achieved reliably and stably. Further, it is possible to improve intimate contact between the transfer sheet film and the print medium, thereby forming a high-quality transfer image.

To attain the above object, according to a third aspect of the invention, there is provided an image-forming apparatus comprising:

printing means for printing an image on a smooth printing surface of a transfer sheet film formed of a water-soluble and soft resin material, by using a sublimable dye ink, thereby causing the sublimable dye ink to be held in the transfer sheet film;

overlay means for overlaying the transfer sheet film to a print medium such that the printing surface of the transfer sheet film faces a surface of the print medium; and heating and pressing means for heating the transfer sheet film and the print medium overlaid to each other while applying pressure thereto, thereby causing diffusion of the sublimable dye ink held in the transfer sheet film into the surface of the print medium for color development, to cause transferring of the image, wherein the heating and pressing means comprises a thermal press for sandwiching and heating the transfer sheet film and the print medium overlaid to each other.

According to this image-forming apparatus, since the transfer sheet film formed of a water-soluble resin material is employed as a transfer medium, it is possible to maintain excellent ink absorbency in a printing process, which allows the sublimable dye ink to be stably impregnated into the transfer sheet film and held in the same without being diffused. Further, since the printing surface of the transfer sheet film has smoothness, and the transfer sheet film is formed of a soft resin, uniform pressure and efficient heat treatment can be applied onto the whole surfaces of the transfer sheet film and the print medium which are in as intimate contact as possible by the thermal press method. This ensures reliable achievement of quick and faithful ink transfer in a state of diffusion of the ink toward the periphery of the transfer sheet film being prevented. It should be noted that the transfer sheet film is preferably formed of a material composed of a principal component of PVA (polyvinyl alcohol) and an additive which exhibits slight tackiness when pressed and heated.

Preferably, the image-forming apparatus includes control means for controlling pressing operation and heating operation of the thermal press separately, and the control means controls the heating and pressing operation of the thermal press such that a start of heating is delayed in timing with respect to a start of pressing.

According to this preferred embodiment, it is possible to remove a small amount of remaining air or microscopic bubbles from the interface between (or between contact surfaces of) the print medium and the transfer sheet film before ink transfer by heating actually starts. As a result, in heat and press treatments for heating and pressing the print medium and the transfer sheet film, the ink is transferred in a state of the print medium and the transfer sheet film being held in highly intimate contact with each other, which makes it possible to more reliably prevent microscopic asperities from being produced on the transferred image, thereby giving a gloss to the image. It should be noted that heating temperature is preferably adjusted such that it increases progressively.

More preferably, the image-forming apparatus further includes a cooling fan under control of the control means, for cooling the print medium after the heating and pressing operation of the thermal press, and the control means causes the cooling fan to start operation, after causing the thermal press in pressure contact with the print medium to stop heating.

According to this preferred embodiment, the print medium having the image transferred thereto is cooled by the cooling fan in a state held in the thermal press. Therefore, it is possible to minimize waste of time and cool the print medium sufficiently. In addition, warpage of the print medium due to heating can be properly prevented.

Preferably, a pair of heat-resistant plates each having a flat shape are interposed between the thermal press and the print medium, for sandwiching the print medium, and the pair of heat-resistant plates have soft cushion sheets laminated on respective surfaces thereof opposed to each other.

According to this preferred embodiment, treatments by the thermal press are performed via the pair of heat-resistant plates and the cushion sheet. As a result, the print medium can be held by the pair of heat-resistant plates in a sandwiched manner even when a presser of the thermal press has been lifted after the heat treatment, so that it is possible to prevent warpage of the print medium effectively. It should be noted that each heat-resistant plate is preferably formed of a material having high thermal conductivity and diffusivity.

The above and other objects, features, and advantages of the invention will become more apparent from the following detailed description taken in conjunction with the accompanying drawings.

DETAILED DESCRIPTION OF PREFERRED EMBODIMENTS

The invention will now be described in detail with reference to drawings showing preferred embodiments thereof. An image-forming apparatus according to a first embodiment of the present invention performs thermal transfer of desired images from a water-soluble transfer sheet film onto a print medium in the form of a resin card. More specifically, the apparatus prints an image e.g. of letters, figures, a background, and/or the like, on the transfer sheet film with sublimable dye ink by the ink jet printing method, and then overlays the transfer sheet film on the print medium, followed by thermally transferring the print image from the transfer sheet film to the print medium to form the transfer image on the latter.

Figure 1:
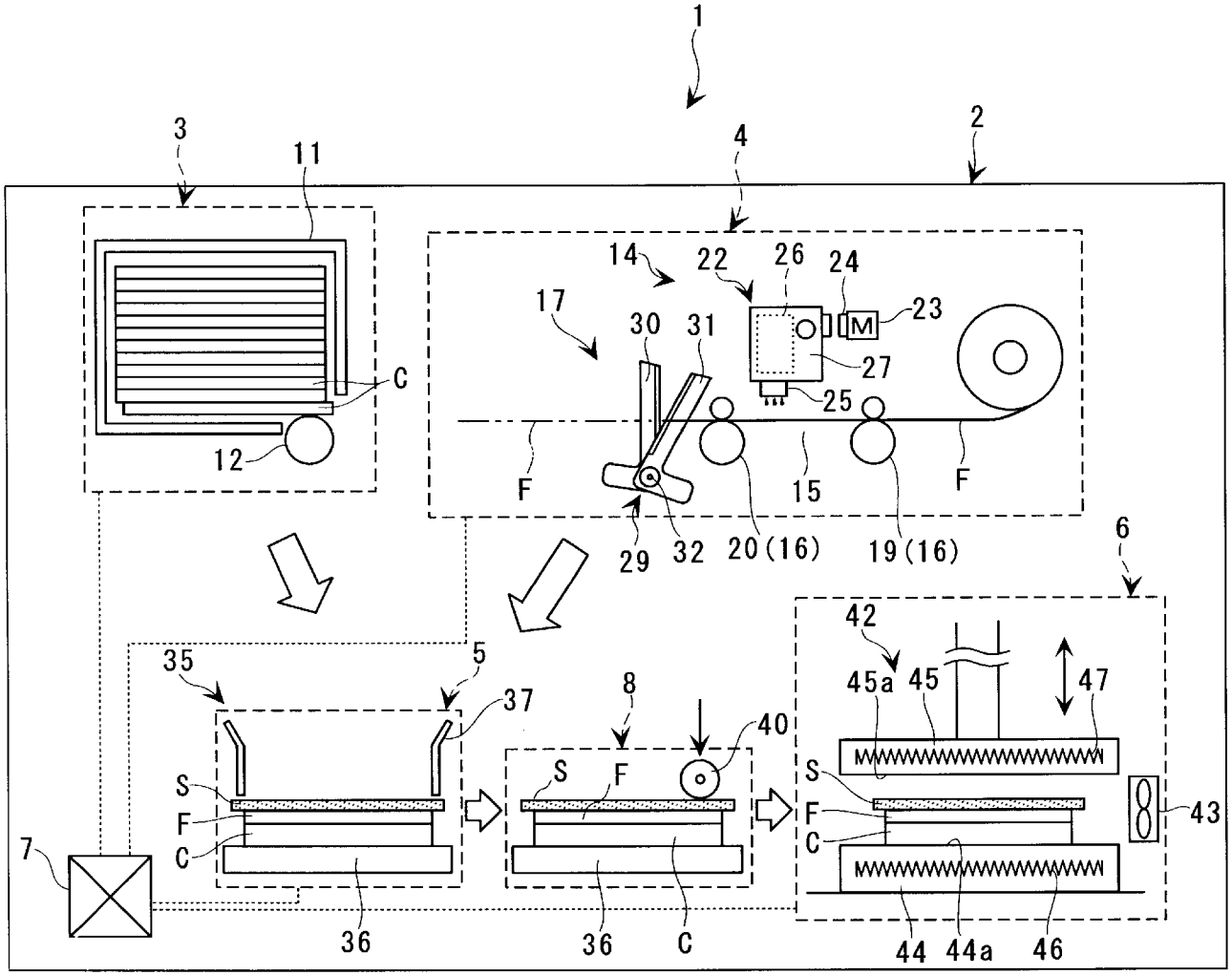
FIG. 1 is a cross-sectional view schematically showing the arrangement of essential operational blocks of an image-forming apparatus according to a first embodiment of the invention.

Referring first to FIG. 1, there are schematically shown essential operational blocks forming the internal structure of the image-forming apparatus. The essential operational blocks of the image-forming apparatus 1 arranged within an apparatus body 2 including an outer shell formed by a box-shaped casing, include a medium feeder block 3 for feeding a print medium C, a printer block 4 for feeding a transfer sheet film F and printing an image on the same, an overlay block 5 for overlying the printed transfer sheet film F and the print medium C to each other, and a transfer block 6 for carrying out thermal transfer of the printed image from the transfer sheet film F to the print medium C overlaid therewith. Further, the image-forming apparatus 1 includes a controller 7 for controlling the overall operations of the essential blocks. Within the apparatus body 2, there is also arranged carrier means that links the above-mentioned essential operational blocks with each other and carries the transfer sheet film F and the print medium C from one block to another.

The medium feeder block 3 is comprised of a media cassette 11 containing a plurality of print media C in a stacked manner, and a feed roller 12 arranged under a lower front portion of the media cassette 11 as a driving roller. The media cassette 11 has an inner plane shape generally similar to the plane shape of the print medium C. Further, the media cassette 11 has a predetermined depth which allows a plurality of print media C to be set in a stacked manner. The feed roller 12 is positioned in a manner held in rolling contact with a forward portion of the underside surface of a lowermost one of the stacked print media C, so as to ensure one-by-one feed of print media C to the overlay block 5.

The printer block 4 is comprised of a printer device 14 which carries out printing on the transfer sheet film F unwound from its roll, carrier roller means 16 which advances the transfer sheet film F along a transport passage 15 such that the transfer sheet film E faces toward the printer device 14, and a cutter device 17 which cuts off the printed portion of the transfer sheet film F advanced by the carrier roller means 16. The transfer sheet film F unwound from its roll by the carrier roller means 16 is advanced to a position facing the printer device 14, where a desired image is printed on the transfer sheet film F, and then the printed portion of the transfer sheet film F is further advanced to the cutter device 17 to be cut off into a transfer sheet film (strip) F in the form of a label.

The carrier roller means 16 is comprised of a feed roller 19 for unwinding the transfer sheet film F and bringing the same to the printing position where printing is carried out by the printer device 14, a delivery roller 20 for delivering the transfer sheet film F received from the feed roller 19 to the cutter device 17, and a motor, not shown, as a drive source for the rollers 19, 20. The feed roller 19 and the delivery roller 20 are each formed by a so-called grip roller. The feed roller 19 is arranged at a location upstream of the printer device 14 in a direction of feeding of the transfer sheet film F, while the delivery roller 20 is arranged at a location downstream of the same.

The printer device 14 is comprised of a head unit 22, a carriage motor 23 as a drive source, and a reciprocating mechanism 24 which receives torque from the carriage motor 23 to reciprocate the head unit 22. The head unit 22 is comprised of an ink jet head 25 having a plurality of nozzles formed in an underside surface thereof, an ink cartridge 26 which supplies sublimable dye ink to the ink jet head 25, and a carriage 27 carrying the ink jet head 25 and the ink cartridge 26. When the reciprocating mechanism 24 causes the carriage 27 to reciprocate, ink droplets are ejected, as required, from the ink jet head 25, whereby printing is effected on the transfer sheet film F.

More specifically, while the transfer sheet film F is fed or advanced intermittently to pass under the head unit 22, the head unit reciprocates in a direction orthogonal to the feeding direction to carry out printing on the transfer sheet film F. That is, printing operation is performed by the ink jet method using the sublimable dye ink such that the reciprocating motion of the head unit 22 and the feed of the transfer sheet film F serve as the main scanning and the sub scanning in printing technology.

The sublimable dye ink is an ink of a sublimable dye material and sublimed by heat. As described in detail hereinafter, in the printing process, the sublimable dye ink is impregnated into the transfer sheet film F and temporarily held in the same. Then, the sublimable dye ink is transferred to the print medium C by heat generated in heat treatment for thermal transfer, and diffused/evaporated in the print medium C to develop color.

The cutter device 17 is arranged at a location downstream of the printer device 14 in a manner facing the transport passage 15. The cutter device 17 is comprised of a scissors-type cutter 29 formed by coupling a fixed blade 30 and a movable blade 31 by a pivot 32 such that the movable blade 30 can pivotally move about the pivot 32, and a cutter-driving mechanism, not shown, for driving the cutter 29 by the movable blade 31 for cutting operation. The fixed blade 30 and the movable blade 31 are positioned in a manner opposed with each other via the transport passage 15 therebetween, and when the cutter-driving mechanism operates, the movable blade 31 pivotally moves to the fixed blade 30 to cut the transfer sheet film F by sandwiching the same between the fixed blade 30 and itself. In short, the printed portion of the transfer sheet film F fed or advanced by the delivery roller 20 is cut off into a label-shaped transfer sheet film F by the pivotal movement of the movable blade 31 and delivered to the overlay block 5.

The overlay block 5 includes an overlay mechanism 35 which overlays the printed transfer sheet film (strip) F to the print medium C, and overlays a cushion sheet S to the transfer sheet film F. The overlay mechanism 35 is comprised of a table 36 also serving as a tray, a feed guide 37 for guiding the print medium C and the transfer sheet film F onto the table 36, and a cushion-introducing device, not shown, for placing the cushion sheet S on the transfer sheet film F.

The feed guide 37 has the shape of a hollow rectangular prism having an inner shape adapted to the plane shapes of the print medium C and the transfer sheet film F. Further, the feed guide 37 has a top portion thereof expanded outward. The print medium C fed from the medium feeder block 3 is thrown into the feed guide 37 from above and then guided by the same to be placed on the table 36 in a positioned state. Similarly, the transfer sheet film F introduced from the printer block 4 is thrown into the feed guide 37, with its printing surface directed downward, and then guided by the same to be placed (overlaid) on the print medium C in a positioned state.

The cushion-introducing device, not shown specifically, is similar in construction to the medium feeder block 3 and comprised of a cushion stocker containing numerous cushion sheets S in a stacked manner and a sheet-feeding roller for feeding the cushion sheets S one by one from the cushion stocker. A cushion sheet S is introduced into the overlay mechanism 35 in a manner inserted horizontally through a gap between the transfer sheet film F already introduced onto the table 36 and the lower end of the feed guide 37. It should be noted that the cushion sheet S is preferably formed of a heat-resistant and soft material, such as silicone, urethane, or vinyl chloride.

Thus, the print medium C and the transfer sheet film F are overlaid to each other such that a print image portion formed of the sublimable dye ink held in the printing surface of the transfer sheet film F is aligned on the print medium C and held in intimate contact with the same, and the cushion sheet S is overlaid to a surface (i.e. surface opposite to the printing surface) of the transfer sheet film F in a manner covering the same. Then, the print medium C, the transfer sheet film F and the cushion sheet S overlaid as above are carried to the transfer block 6 together with the table 36, where they are moved from the table 36 to the transfer block 6.

It is preferred that an air-removing block 8 is provided on a transport passage between the overlay block 5 and the transfer block 6. The air-removing block 8 includes a press roller 40 which relatively rolls on the overlaid body formed by the print medium C, the transfer sheet film F and the cushion sheet S, on its way from the overlay block 5 to the transfer block 6, to thereby expel or remove air trapped between the print medium C and the transfer sheet film F. As a result, the print medium C and the transfer sheet film F in complete and intimate contact with each other are introduced into the transfer block 6.

When it is required to transfer and form print images on the both surfaces of the print medium C, respectively, the printing operation and the cutting operation are each carried out twice to thereby prepare two transfer sheet film strips F. Then, in the overlay block 5, the transfer sheet film strips F are overlaid to the respective front and back surfaces of the print medium C in a manner such that the printing surfaces of the transfer sheet film strips F face the respective surfaces of the print medium C, followed by cushion sheets S being laminated on the respective transfer sheet film strips F overlaid to the print medium C. In short, one cushion sheet S, one transfer sheet film F, the print medium C, the other transfer sheet film F and the other cushion sheet S are overlaid to each other (i.e. thrown into the overlay mechanism 35) in the mentioned order.

The transfer block 6 is comprised of a thermal press 42 for heating and pressing the print medium C which has been subjected to the overlay process and a cooling fan 43 for cooling the print medium C which has been heated. Further, the thermal press 42 is comprised of a press table 44 for receiving the print medium C thereon, a presser plate 45 opposed in parallel to the press table 44, and a lift mechanism, not shown, for lifting and lowering the presser plate 45 with respect to the press table 44.

The press table 44 has a heater 46 incorporated therein, and a press-receiving surface 44*a* formed in parallel with the print medium C and having a larger area than that of the print medium C. The print medium C which has been subjected to the overlay process is placed on the press table 44, in a horizontal position. The presser plate 45 has a heater 47 incorporated therein similarly to the press table 44, and a press surface 45*a* opposed in parallel to the press-receiving surface 44*a*. The lift mechanism is comprised of a linkage, such as a cam mechanism and a toggling mechanism. The lift mechanism moves the presser plate 45 downward to the press table 44 to thereby press the press surface 45*a* against the press-receiving surface 44*a*. It is preferred that the heaters 46, 47 are each formed by a far infrared heater.

The print medium C, the transfer sheet film F and the cushion sheet S placed on the press table 44 in a horizontal position are pressed against the press table 44 by the presser plate 45 moved downward by the lift mechanism, and heated by the heaters 46, 47, in a state in contact with each other. When the heat and press treatments are carried out by the thermal press 42, the sublimable dye ink held in the transfer sheet film F is transferred to the print medium C, whereby the image is transferred to the print medium C and formed on the same. In the thermal press 42, the heating operations of the heaters 46, 47 and the pressing operation of the presser plate 45 are controlled individually by the controller 7 (as described in detail hereinafter).

The cooling fan 43 is arranged in a manner facing toward the thermal press 42, and properly sends cooling air to the same, under the control of the controller 7. More specifically, the cooling fan 43 faces toward a gap between the presser plate 45 and the press table 44 and forcibly cools the heated print medium C by the cooling air. As a result, the print medium C on which the image has been transferred by heating is cooled to a temperature low enough to for a user to hold by hand.

Figure 2A:
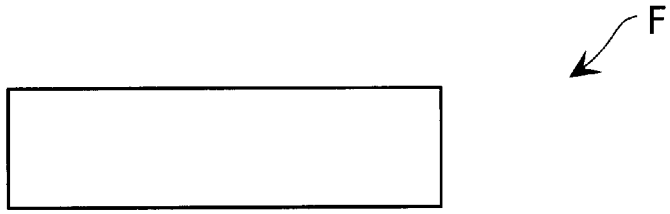
FIG. 2A is a cross-sectional view of a structure of a transfer sheet film for use in the FIG. 1 image-forming apparatus.

Now, before describing details of the control process for controlling the operation of the thermal press 42, a transfer sheet film F and print media C as well as an image-forming process using the transfer sheet film F and one of the print media C will be described in more detail. FIG. 2A schematically shows the structure of the transfer sheet film F, and FIGS. 2B, 2C those of the print media C of two kinds, while FIGS. 3A to 3D schematically illustrates the process of an image being transferred from the transfer sheet film F to the print medium C.

The transfer sheet film F is a so-called image-receiving sheet, which is formed of a heat-resistant and water-soluble resin material forming a single layer as shown in FIG. 2A. The transfer sheet film F is capable of temporarily holding the sublimable dye ink directly ejected thereon for printing. The water-soluble resin of the transfer sheet film F is composed of a principal component of PVA (polyvinyl alcohol), and receives and holds the sublimable dye ink in a substantially upper half area thereof in the direction of thickness. In the present embodiment, since the transfer sheet film F is formed of a water-soluble resin, it is possible to maintain excellent ink absorbency for absorbing the sublimable dye ink in the printing process, which allows the sublimable dye ink to be stably impregnated into the transfer sheet film F and held in the same without being diffused.

Further, the transfer sheet film F is composed of not only PVA as the principal component but also the additives of a material which exhibits slight tackiness when pressed and heated, and a material which exhibits a slightly curable property when exposed to the air after having been pressed and heated. Therefore, the heat from the thermal press 42 causes the transfer sheet film F to exhibit the weak tackiness and firmly stick to the print medium C, while the air from the cooling fan 43 causes the transfer sheet film F to exhibit the slight curability, thereby making the same easy to separate from the print medium C.

Further, the transfer sheet film F is configured such that the printing surface through which the sublimable dye ink is received is smooth, and the whole of the transfer sheet film F is soft, so as to enable the transfer sheet film F to be in proper intimate contact with the print medium C. Therefore, when the transfer sheet film F and the print medium C are overlaid to each other and pressed, air and bubbles trapped between the contact surfaces of the transfer sheet film F and the print medium C are expelled to bring the two into intimate contact with each other.

Figure 2B:
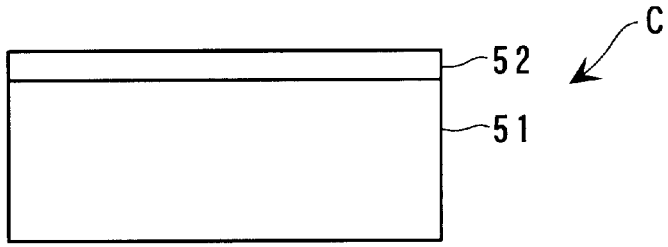
FIG. 2B is a cross-sectional view of a structure of an inexpensive print medium for use in the FIG. 1 image-forming apparatus.
Figure 2C:
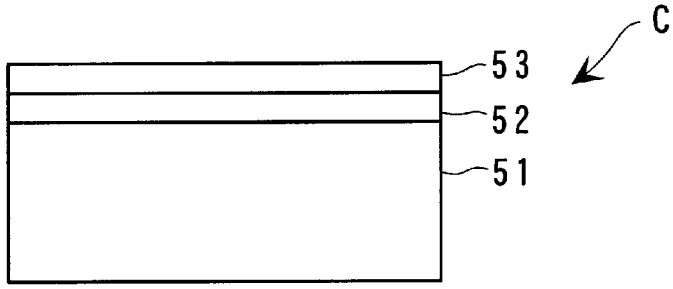
FIG. 2C is a cross-sectional view of a structure of a high-grade print medium for use in the FIG. 1 image-forming apparatus.

On the other hand, FIGS. 2B and 2C show the laminate structures of the two kinds of print media C provided in the present embodiment. The print medium C shown in FIG. 2B is comprised of a substrate layer 51 and an ink-fixing layer 52 laminated on a surface of the substrate layer 51, while the print medium C shown in FIG. 2C further has a fluorine film layer 53 laminated on a surface of an ink-fixing layer 52 in place of a laminating film. The print media may be roll paper, printing tape or cutsheet paper, but in the present embodiment, description will be given by taking a card as an example of the print medium.

The substrate layer 51 of each of the print media (card) C is formed of a plastic film e.g. of PVC (polyvinyl chloride) or PET (polyethylene terephthalate), or a synthetic paper so as to maintain the rigidity of the entire print media C. Further, in general, the substrate layer 51 is basically formed of a basically white-colored material. The ink-fixing layer 52 is formed e.g. of a transparent PET film and serves as a layer which is finally impregnated with sublimable dye ink for printing. In short, an image is thermally transferred into the ink-fixing layer 52 and fixed therein. It is preferred that the surface of the print medium C, i.e. the surface of the ink-fixing layer 52 which faces the printing surface of the transfer sheet film F should be also configured to be smooth.

Figure 3A:
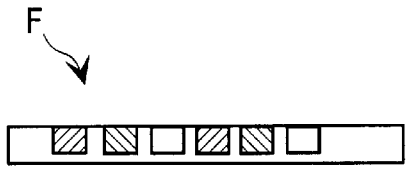
FIGS. 3A to 3D are cross-sectional views of the transfer sheet film and a print medium, schematically illustrating a process of transferring an image from the transfer sheet film to the print medium to form the image on the print medium.
Figure 3B:
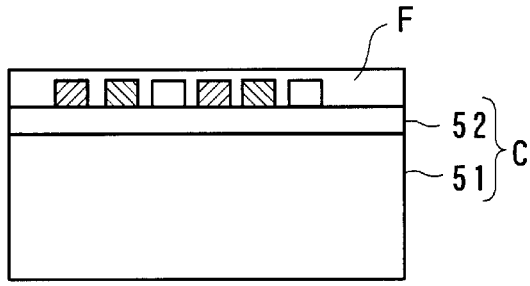

As shown in FIG. 3A, when the image is printed on the transfer sheet film F by the ink jet printing method, ink droplets of the sublimable dye ink are impregnated into the transfer sheet film F and held in the same. At this time point, the ink droplets are held in the substantially upper half of the transfer sheet film F without being diffused into the periphery of the same. Then, the transfer sheet film F is turned upside down and overlaid to the print medium C such that the printing surface of the transfer sheet film F faces the print medium C (FIG. 3B). At this time point, as described hereinbefore, air or bubbles are completely expelled from the interface or between contact surfaces of the transfer sheet film F and the print medium C overlaid to each other.

Figure 3C:
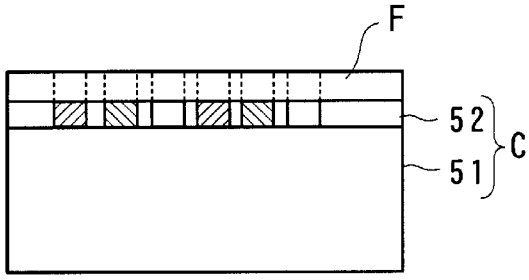
Figure 3D:
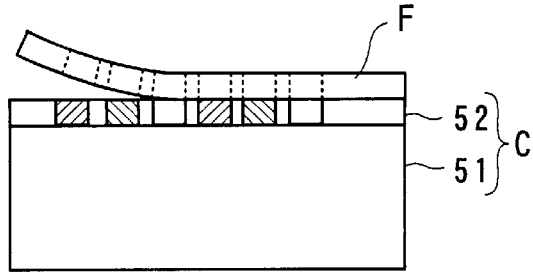

When the print medium C overlaid with the transfer sheet film F is heated under pressure contact with the same, more specifically, in a state of the transfer sheet film F and the print medium C being relatively pressed against each other, the ink droplets penetrate up to the proximity of the boundary between the ink-fixing layer 52 and the substrate layer 51 thereunder as migration particles having sizes at a molecular level (FIG. 3C). In other words, when the ink droplets held in the transfer sheet film F are heated, they penetrate into the ink-fixing layer 52 to be evaporated diffused and subjected for color development in the ink-fixing layer 52, whereby the image is fixed and formed in the ink-fixing layer 52. Thereafter, the transfer sheet film F is separated from the print medium C (FIG. 3D) to expose the ink-fixing layer 52 to the outside, whereby the print medium (card) C having the image thermally transferred into the ink-fixing layer 52 is produced.

The transfer sheet film F separated from the print medium C exhibits its water-soluble property by immersion in water so as to be dissolved. As a result, it is possible to cause the original image faintly left on the transfer sheet film F to completely disappear, so that forgery of the print medium C can be also prevented. Needless to say, the print medium C having the transfer sheet film F laminated thereon may be immersed in water to thereby dissolve the transfer sheet film F alone for removal (separation) of the same from the print medium C.

Similarly, when the FIG. 2C print medium C having the fluorine film layer 53 laminated thereon is used for printing, the heating of the transfer sheet film F causes the ink droplets to pass through the fluorine film layer 53 to be diffused and fixed in the ink-fixing layer 52. In other words, when the transfer sheet film F is separated, the print medium C having the fluorine film layer 53 as the outermost surface layer thereof for protecting the image transferred into the ink-fixing layer 52 is produced. Thus, the print medium C having the image formed thereon is made more excellent in weather resistance, light resistance, heat resistance, rub or abrasion resistance and chemical resistance by the coating of the fluorine film layer 53. Further, the fluorine film layer 53 gives a high gloss to the print medium C.

It should be noted that a print medium C may have a laminate structure symmetrical with respect to the substrate layer 51 such that thermal image transfer can be effected on both sides thereof. Further, it is preferred that the transfer sheet film F is slightly larger than the print medium C for easy separation from the same. This makes it possible to provide a peeling margin for the transfer sheet film F as well as to carry out proper image transfer even up to all edges of the print medium C (edge-to-edge printing/transfer). Moreover, since it is possible to fix ink even in the substrate layer 51 depending on the degree of heating, the transparent ink-fixing layer 52 can be dispensed with for reduction of manufacturing costs.

Next, description will be given of control processes executed by the controller 7 for controlling overall operations of the essential blocks of the image-forming apparatus 1, with the principal emphasis on a control process for the transfer block 6. The controller 7 is comprised of a CPU for controlling various operations of the image-forming apparatus 1, a ROM for storing control programs and data for controlling the essential blocks, a RAM for use as various work areas for carrying out the respective control processes, and drive circuits for driving the respective essential blocks of the image-forming apparatus 1. The controller 7 controls the essential blocks separately and in a manner correlated with each other, particularly for achieving thermal transfer of a clear image from the transfer sheet film F to the print medium C.

The controller 7 controls heating conditions and the like in the transfer block 6 by looking up its own condition tables prepared by taking the factor of the material quality of the print medium C into account. More specifically, the controller 7 determines the heating temperature and pressing force of the thermal press 42 and the driving of the cooling fan 43 as well as timing for starting the operations of the thermal press 42 and the cooling fan 43. Alternatively, the image-forming apparatus 1 may be linked to a personal computer storing attribute information of the transfer sheet film F and the print medium C, so as to allow the heating conditions and the like to be determined based on the information.

Now, the control process for the transfer block 6, which is executed based on the determined heating conditions and the like, and the flow of the control process will be described in detail. First, the print medium (overlaid body) C introduced onto the press table 44 of the thermal press 42 after the overlay process is pressed against the press table 44 in a state of the thermal press 42 being driven for pressing operation alone prior to heating operation. More specifically, the print medium (overlaid body) C which has been subjected to the overlay process is pressed from the transfer sheet film side via the cushion sheet S by an adjusted pressing force of the presser plate 45 which is moving downward in a state in which the heaters 46, 47 are not driven for heating. As a result, air is removed from the interface between the print medium C and the transfer sheet film F, and the print medium C and the transfer sheet film F are brought into firm and intimate contact with each other. It should be noted that the downward movement speed of the presser plate 45 is preferably reduced when the presser plate 45 reaches a position close to its lower movement end, so as to progressively increase the pressing force to a predetermined pressing force.

Then, the two heaters 46, 47 are started simultaneously and driven for operating at a predetermined heating temperature. In this case, the thermal press 42 stops pressing and starts heating almost simultaneously. More specifically, in the heat and press treatments carried out sequentially by the thermal press 42, at least the start of heating by the heaters 46, 47 is delayed in timing with respect to the start of pressing by the presser plate 45. The heat and press treatments are carried out over a predetermined time period, whereby the print image printed on the transfer sheet film F is transferred onto the print medium C. It should be noted that the heating temperature is preferably controlled such that it increases progressively (stepwise or continuously).

Then, the driving of the heaters 46, 47 for heat generation is stopped, and the driving of the cooling fan 43 is started, with the pressure contact state between the print medium C and the thermal press 42 being maintained. As a result, the print medium (overlaid body) C is rapidly cooled in a state sandwiched between the presser plate 45 and the press table 44, whereby warpage, distortion or deformation, which might be caused by heating, of the print medium (overlaid body) C is prevented. When the print medium (overlaid body) C is cooled down to some temperature (below a softening temperature of the print medium C), the presser plate 45 is moved upward, and then the operations of the thermal press 42 and the cooling fan 43 are stopped. Thus, the processing in the transfer block 6 is completed.

The thermal press 42 may be controlled such that when print images are thermally transferred to both sides of a print medium C, the heater 46 of the press table 44 and the heater 47 of the presser plate 45 are both driven for heat generation, but when an image is thermally transferred only to a front surface of a print medium C, the heater 47 of the presser plate 45 alone is driven for heat generation.

According to the image-forming apparatus 1 described above, the sequence of control processes allows uniform pressure and efficient heat treatment to be applied to the whole surfaces of a transfer sheet film F and a print medium C overlaid in intimate surface contact with each other, by the thermal press method, so that it is possible to form a clear transfer image with no color irregularity on the transfer surface of the print medium C without forming microscopic asperities on the same.

Figure 4:
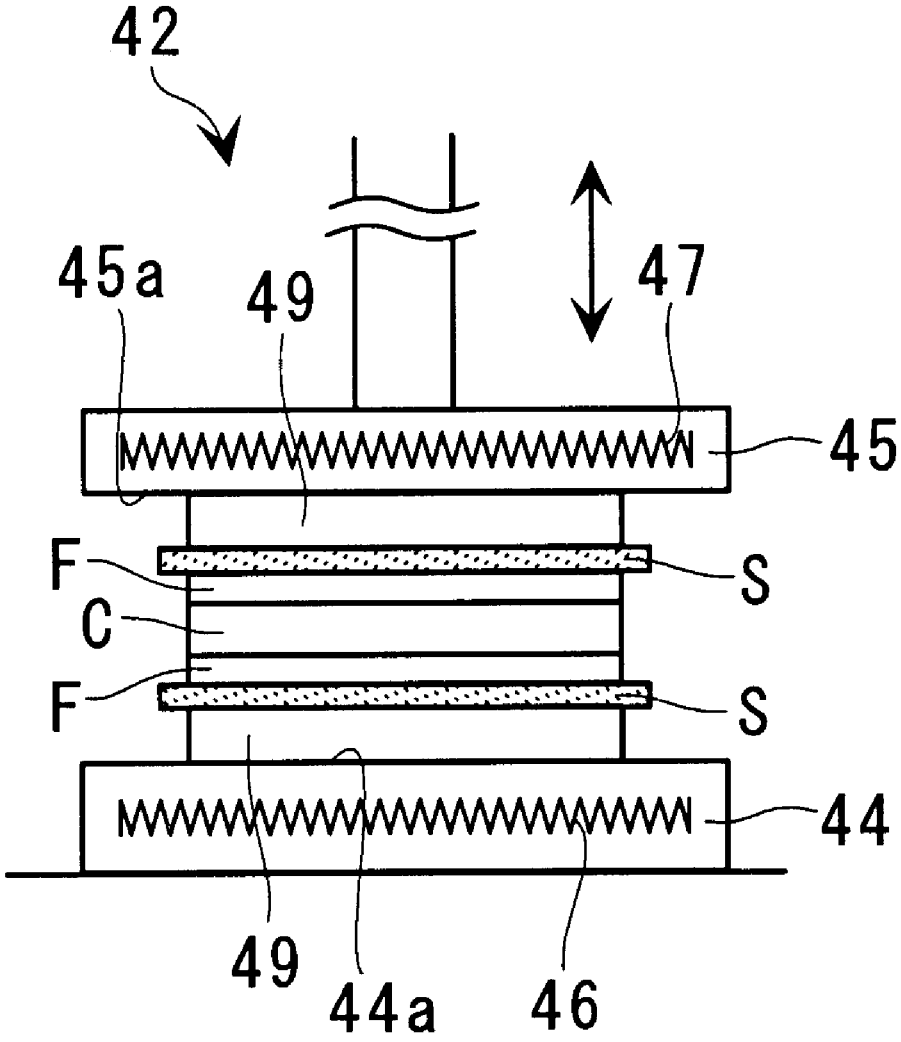
FIG. 4 is a cross-sectional view of a thermal press of an image-forming apparatus according to a second embodiment of the invention.

Next, an image-forming apparatus according to a second embodiment of the invention will be described with reference to FIG. 4. In the present embodiment, a print medium C is brought to a thermal press 42 in a state sandwiched between a pair of heat-resistant plates 49, 49 and is heated and pressed via the heat-resistant plates 49, 49. The pair of heat-resistant plates 49, 49 are each formed of a material having high thermal conductivity and diffusivity, such as a metal, a heat-resistant tempered glass, silicon, ceramic, or the like, and each of the heat-resistant plates 49, 49 has a flat plate shape. Further, the pair of heat-resistant plates 49, 49 have cushion sheets S, S laminated on respective surfaces thereof opposed to each other. In short, the print medium C which has been subjected to an overlay process is placed on a press table 44 in a state sandwiched between the pair of heat-resistant plates 49, 49 from both upper and lower sides thereof, and is subjected to heat and press treatments.

According to this image-forming apparatus, since the pair of heat-resistant plates 49, 49 can prevent warpage of the print medium C due to heat, it is possible to cool the print medium C by a cooling fan 43 in an additional manner after the heat and press treatments by the thermal press 42.

It is further understood by those skilled in the art that the foregoing are preferred embodiments of the invention, and that various changes and modifications may be made without departing from the spirit and scope thereof.

What is claimed is:

1. An image-forming method comprising the steps of:

printing an image on a printing surface of at least one sheet of a transfer sheet film prepared in a manner associated with at least one surface of a print medium, by using a sublimable dye ink, thereby causing the sublimable dye ink to be held in the at least one sheet of the transfer sheet film;

overlaying the at least one sheet of the transfer sheet film to the print medium such that the printing surface of the at least one sheet of the transfer sheet film faces the at least one surface of the print medium;

transferring the image by heating the at least one sheet of the transfer sheet film and the print medium overlaid to each other while applying pressure thereto, thereby causing diffusion of the sublimable dye ink held in the at least one sheet of the transfer sheet film into the at least one surface of the print medium for color development; and removing the at least one sheet of the transfer sheet film from the print medium having the image formed thereon, wherein the transfer sheet film is formed of a water-soluble and soft resin material, and the printing surface is formed to be a smooth surface.

2. An image-forming method according to claim 1, wherein the printing step includes printing images on respective printing surfaces of two sheets of the transfer sheet film prepared in a manner associated with front and back surfaces of the print medium, by using the sublimable dye ink, thereby causing the sublimable dye ink to be held in the two sheets of the transfer sheet film, wherein the overlaying step includes overlaying the two sheets of the transfer sheet film to the print medium such that the printing surfaces of the two sheets of the transfer sheet film face the front and back surfaces of the print medium, respectively, wherein the transferring step includes transferring the images by heating the two sheets of the transfer sheet film and the print medium overlaid to each other while applying pressure thereto, thereby causing diffusion of the sublimable dye ink held in the two sheets of the transfer sheet film into the front and back surfaces of the print medium for color development, and wherein the removing step includes removing the two sheets of the transfer sheet film from the print medium having the images formed thereon.

3. An image-forming method according to claim 2, wherein the transferring step includes simultaneously pressing and heating front and back surface sides of the print medium overlaid with the respective two sheets of the transfer sheet film.

4. An image-forming method according to claim 1, wherein the transferring step includes the step of pressing and the step of heating, these two steps overlapping each other in timing such thin the step of pressing starts before the step of heating starts, and the step of heating ends before the step of pressing ends.

5. An image-forming method according to claim 1 further including the step of removing air from an interface between the print medium and the transfer sheet film overlaid to each other, between the overlaying step and the transferring step.

6. An image-forming method according to claim 5, wherein the step of removing air includes overlaying a soft cushion sheet to the print medium and the transfer sheet film overlaid to each other, and pressing the transfer sheet film against the print medium via the cushion sheet.

7. An image-forming method according to claim 1 further including the step of forcibly cooling the print medium between the transferring step and the step of removing air.

8. An image-forming method according to claim 4 further including the step of forcibly cooling the print medium between ending of the step of heating and ending of the step of pressing in the transferring step.

9. An image-forming method according to claim 1, wherein the step of removing the at least one sheet of the transfer sheet film includes dissolving the transfer sheet film in water.

10. An image-forming method according to claim 1, wherein the printing step includes printing the image by an ink jet printing method.

11. An image-forming method according to claim 1, wherein the transfer sheet film is formed of a material which exhibits slight curability when heated.

12. An image-forming method according to claim 1, wherein the print medium is a card.

13. A transfer sheet film for use in an image-forming method comprising the steps of:

printing an image on a printing surface of at least one sheet of the transfer sheet film prepared in a manner associated with at least one surface of a print medium, by using a sublimable dye ink, thereby causing the sublimable dye ink to be held in the at least one sheet of the transfer sheet film, overlaying the at least one sheet of the transfer sheet film to the print medium such that the printing surface of the at least one sheet of the transfer sheet film faces the at least one surface of the print medium, transferring the image by heating the at least one sheet of the transfer sheet film and the print medium overlaid to each other while applying pressure thereto, thereby causing diffusion of the sublimable dye ink held in the at least one sheet of the transfer sheet film into the at least one surface of the print medium for color development, and removing the at least one sheet of the transfer sheet film from the print medium having the image formed thereon, wherein the transfer sheet film is formed of a water-soluble and soft resin material, and the printing surface is formed to be a smooth surface.

14. An image-forming apparatus comprising:

printing means for printing an image on a smooth printing surface of a transfer sheet film formed of a water-soluble and soft resin material, by using a sublimable dye ink, thereby causing the sublimable dye ink to be held in the transfer sheet film;

overlay means for overlaying the transfer sheet film to a print medium such that the printing surface of the transfer sheet film faces a surface of the print medium; and heating and pressing means for heating the transfer sheet film and the print medium overlaid to each other while applying pressure thereto, thereby causing diffusion of the sublimable dye ink held in the transfer sheet film into the surface of the print medium for color development, to cause transferring of the image, wherein said heating and pressing means comprises a thermal press for sandwiching and heating the transfer sheet film and the print medium overlaid to each other.

15. An image-forming apparatus according to claim 14, including control means for controlling pressing operation and heating operation of said thermal press separately, and wherein said control means controls the heating and pressing operation of said thermal press such that a start of heating is delayed in timing with respect to a start of pressing.

16. An image-forming apparatus according to claim 14, further including a cooling fan under control of said control means, for cooling the print medium after the heating and pressing operation of said thermal press, and wherein said control means causes said cooling fan to start operation, after causing said thermal press in pressure contact with said print medium to stop heating.

17. An image-forming apparatus according to claim 14, wherein a pair of heat-resistant plates each having a flat shape are interposed between said thermal press and the print medium, for sandwiching the print medium, and wherein said pair of heat-resistant plates have soft cushion sheets laminated on respective surfaces thereof opposed to each other.

18. An apparatus according to claim 14, wherein said transfer sheet film is formed of a material which exhibits slight curability when heated.

19. An apparatus according to claim 14, wherein said print medium is a card.

20. An image-forming method according to claim 1, wherein the transfer sheet film is comprised of two sheets of transfer sheet film prepared in a manner associated with front and back surfaces of the print medium, the printing step causes the subliminable dye ink to be held in the two sheets of transfer sheet film, the overlaying step causes the two sheets of transfer sheet film to face the front and back surfaces of the print medium, and the transfer step causes diffusion of the subliminable dye ink held in the two sheets of transfer sheet firm into the front and back surfaces of the print medium for color development.

* * * * *